US005282298A

United States Patent [19]

Freermann

[11] Patent Number: 5,282,298

[45] Date of Patent: Feb. 1, 1994

[54] PILE-EDGE DETECTOR FOR PILE-FABRIC TREATMENT MACHINE

[75] Inventor: Johannes Freermann, Ochtrup, Fed. Rep. of Germany

[73] Assignee: Carl Schmale GmbH & Co. KG, Ochtrup, Fed. Rep. of Germany

[21] Appl. No.: 706,593

[22] Filed: May 28, 1991

[30] Foreign Application Priority Data

Dec. 1, 1990 [DE] Fed. Rep. of Germany ... 9016342[U]

[51] Int. Cl.[5] ..... G01V 9/04; D06C 13/00

[52] U.S. Cl. ..... 28/159; 28/160; 26/2 R; 250/548; 250/561

[58] Field of Search ..... 28/170, 159, 160, 162, 28/100, 165; 26/2 R, 51.5, 75, 76; 73/159, 160; 250/548, 559, 561, 560, 563; 356/429, 400

[56] References Cited

U.S. PATENT DOCUMENTS

| | | | |
|---|---|---|---|
| 2,092,142 | 9/1937 | Schuz | 250/559 |
| 2,972,794 | 2/1961 | Saul et al. | 26/51.5 |
| 3,179,800 | 4/1965 | McNamara | 250/559 |
| 3,758,924 | 9/1973 | Holm | 26/16 |
| 4,025,025 | 5/1977 | Bartel et al. | 250/548 |
| 4,303,189 | 12/1991 | Wiley et al. | 26/51.5 |
| 4,624,036 | 11/1986 | Diggle, Jr. et al. | 26/51.4 |
| 4,662,757 | 5/1987 | Duran, Jr. | 250/561 |

FOREIGN PATENT DOCUMENTS

| | | |
|---|---|---|
| 2059637 | 6/1972 | Fed. Rep. of Germany . |
| 3412385 | 10/1985 | Fed. Rep. of Germany . |
| 8907659 | 9/1989 | Fed. Rep. of Germany . |

*Primary Examiner*—Clifford D. Crowder
*Assistant Examiner*—Amy B. Vanatta
*Attorney, Agent, or Firm*—Herbert Dubno; Andrew Wilford

[57] ABSTRACT

A pile-detecting apparatus is used in a machine wherein a pile fabric is deflected over a smooth surface of a roll to detect the edge between the pile-free portion of the fabric and the portion with the pile, which edge runs parallel to the displacement direction of the fabric over the roll. The apparatus has a support plate, a frame carrying the plate, a plurality of rollers mounted on the frame and riding on the surface of the deflecting roll, and at least one light source on the plate for generating light beams and directing same tangentially of the surface. Respective detectors on the plate receive the respective light beams.

16 Claims, 5 Drawing Sheets

PILE-EDGE DETECTOR FOR PILE-FABRIC TREATMENT MACHINE

FIELD OF THE INVENTION

The present invention relates to a pile-fabric treatment machine. More particularly this invention concerns an apparatus for detecting the edge of the pile, that is the location where the pile-free edge region of the textile starts, on the goods passing through such a treatment machine.

BACKGROUND OF THE INVENTION

In a treatment machine for terry or pile-type fabrics it is frequently necessary to accurately determine just where the pile or looped part of the textile ends and the pile-free edge region of the textile begins. This must be done when selvedging or trimming the goods and while the goods are invariably passing at a relatively high speed through the treatment machine.

German utility model 8,907,659 filed 22 Jun. 1989 and assigned to Carl Schmale GmbH (U.S. Pat. No. 07/777,563 filed 03 Dec. 1991) describes such an arrangement that is associated with a standard deflecting roll or beam of such a machine. The apparatus has one or more light sources that direct beams tangentially of the deflecting beam to respective photocells. The beams run just above the surface of the deflecting roll so that they are interrupted by the pile but not by the pile-less portion of the goods, making it possible to very accurately determine the location of the pile edge.

The deflecting roll can be fairly long so that it can be bent slightly out of position in some applications. In this case it is pulled away from the stationarily mounted light source so that same can give false readings, as it becomes possible for the pile part of the goods to slip between the beam and the roll.

OBJECTS OF THE INVENTION

It is therefore an object of the present invention to provide an improved pile detector for a pile-fabric treatment apparatus.

Another object is the provision of such an improved pile detector for a pile-fabric treatment apparatus which overcomes the above-given disadvantages, that is which does not give false readings even when the deflector roll beam is deformed somewhat.

SUMMARY OF THE INVENTION

A pile-detecting apparatus is used in a machine wherein a pile fabric is deflected over a smooth surface of a roll to detect the edge between the pile-free portion of the fabric and the portion with the pile, which edge runs parallel to the displacement direction of the fabric over the roll. The apparatus has a support plate, a frame carrying the plate, a plurality of rollers mounted on the frame and riding on the surface of the deflecting roll, and at least one light source on the plate for generating light beams and directing same tangentially of the surface. Respective detectors on the plate receive the respective light beams.

Thus with the system of this invention any bending of the deflecting roll can be followed by the edge-detecting apparatus. Since it rides on the roll, it will follow such deformation. Furthermore the rollers allow the pile-detector to be moved and positioned anywhere along the nonrotatable deflecting roll according to the width of the goods being treated.

The roll surface according to this invention is cylindrical and centered on an axis. Furthermore the plate is mounted on the frame for movement radially of the axis and so that it can be secured in any of a plurality of radially offset positions thereon. Similarly the plate can move on the frame tangentially of the surface and can be secured in any of a plurality of tangentially offset positions thereon. These movements are made possible by providing bolts engaged through slots in the plate and frame or through a bracket forming part of the plate or frame.

According to another feature of this invention the machine includes a stationary base and the apparatus has an elastically deformable support strut extending between the base and the frame and partially supporting the apparatus on the base. This strut is a leaf spring and a pivot is provided between the support and the frame. To ensure that the edge of the pile area is well defined nozzles are provided on the plate for blowing the pile of the fabric parallel to the surface.

In accordance with the invention there are three such detectors and the generator emits light beams from two offset locations at the detectors. One of the light beams is fan-shaped and impinges two of the detectors and a controller is connected to the machine and receives outputs from the detectors for controlling the machine in accordance with the outputs.

Furthermore according to this invention when the light-beam generator and the detector are in contact with one another in the region of the transversely extending pileless region, detection of the pile edge in the longitudinal direction is switched off.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
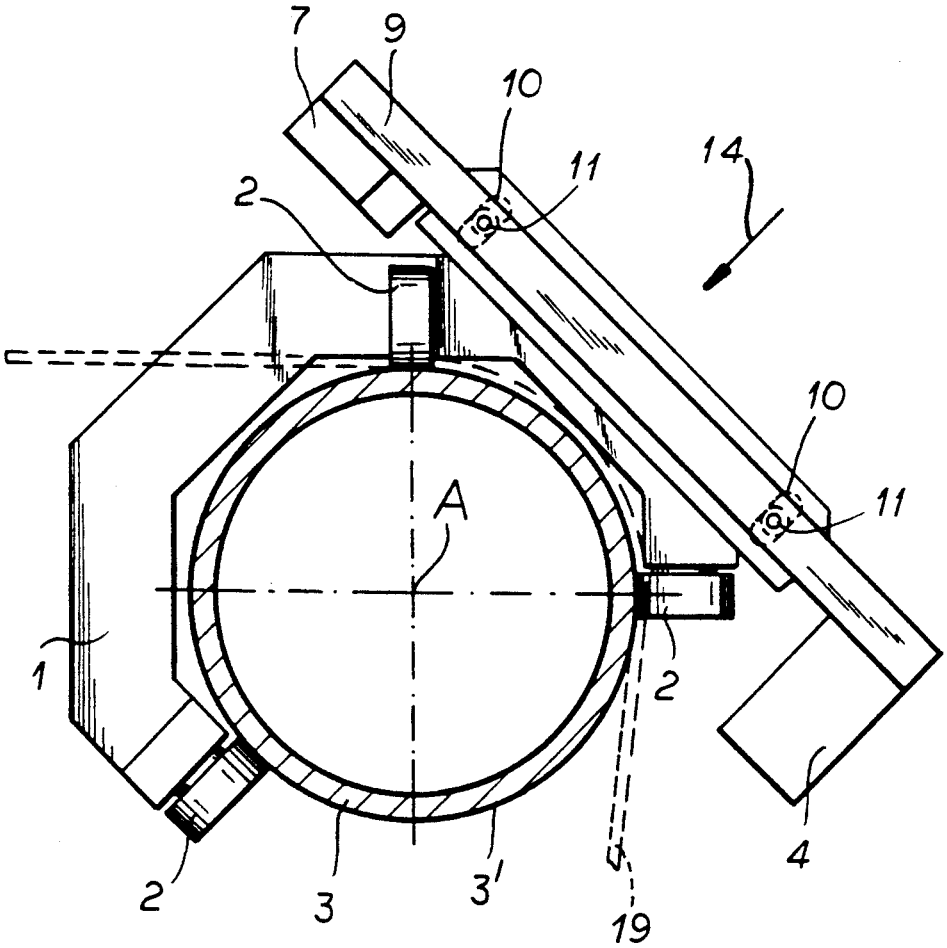
FIG. 1 is a vertical section partly in diagrammatic form through the apparatus of this invention.
Figure 2:
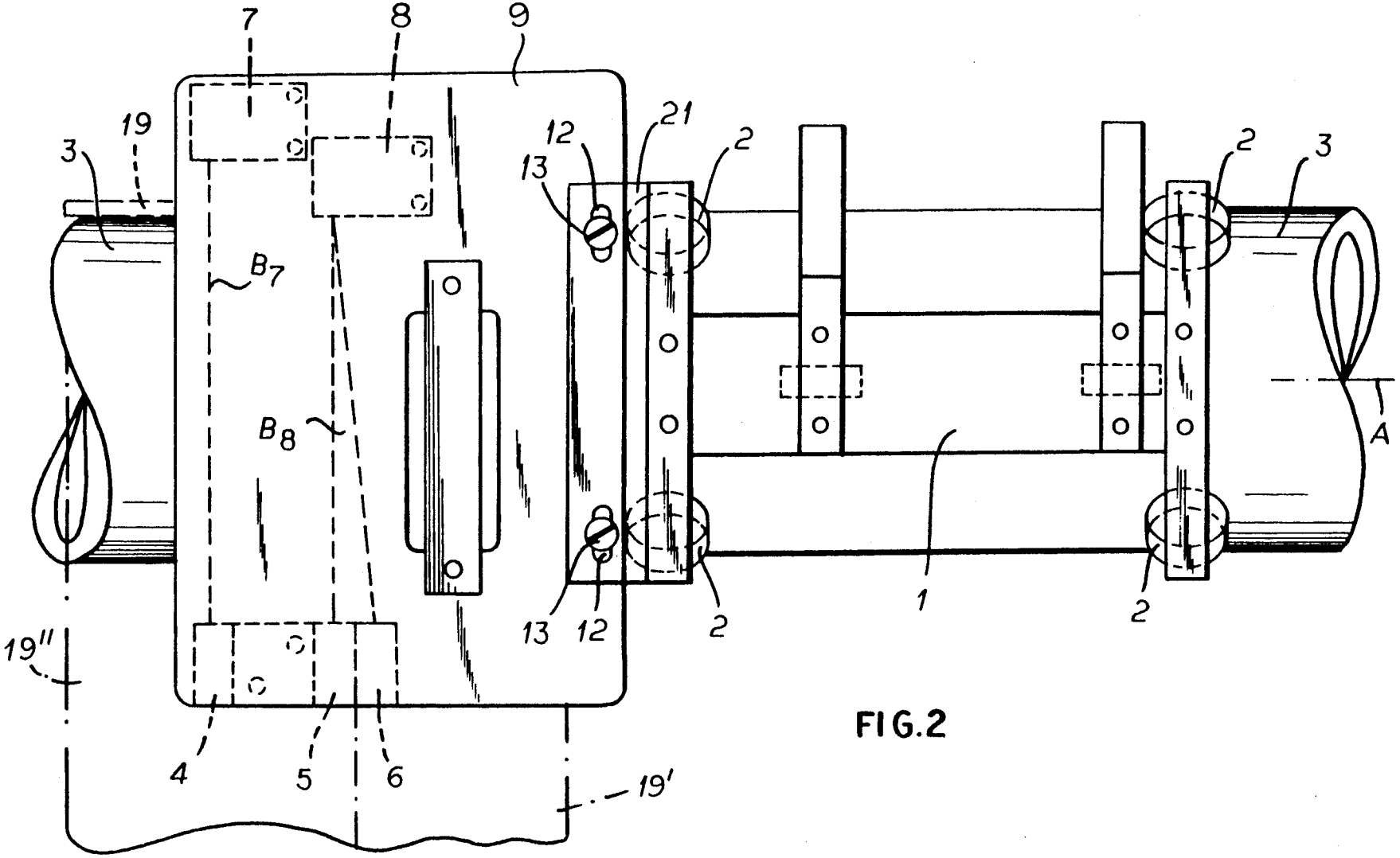
FIG. 2 is a top view of the apparatus of FIG. 1.
Figure 5:
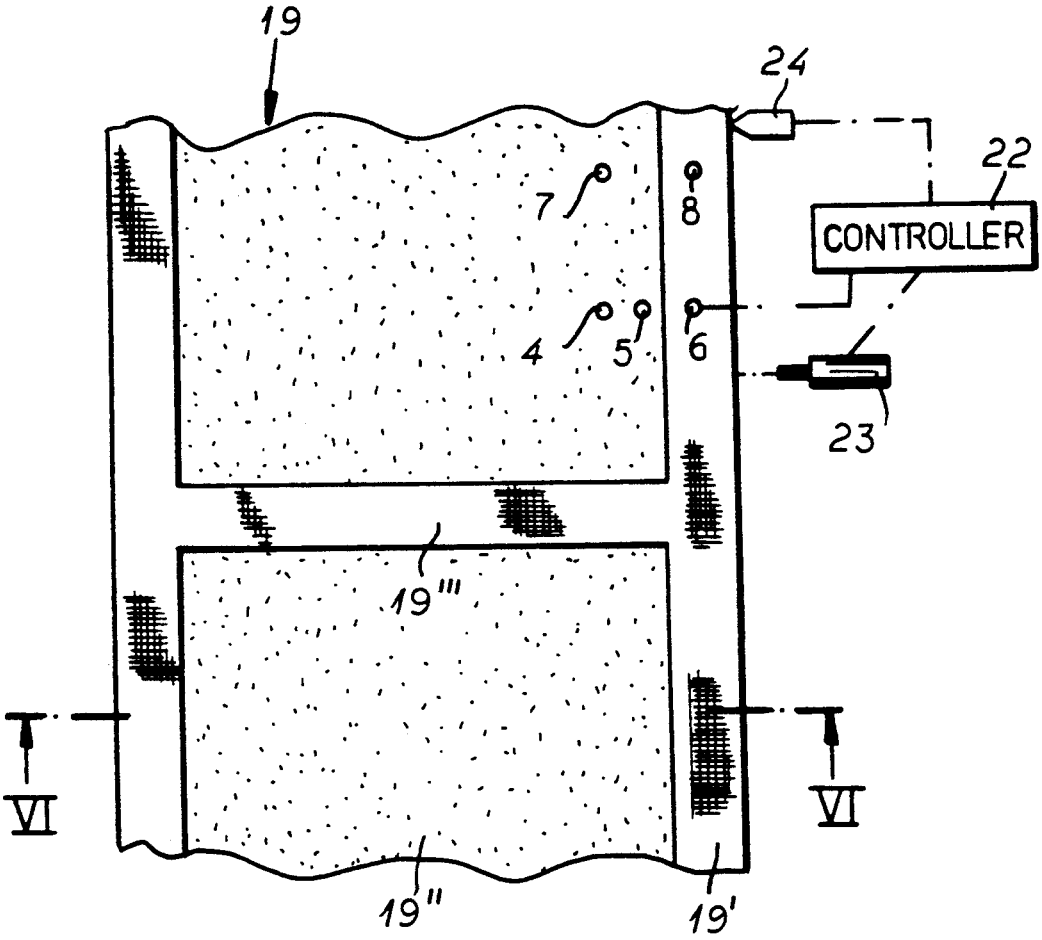
FIG. 5 is a small-scale and partly diagrammatic top view illustrating the method of this invention.
Figure 6:
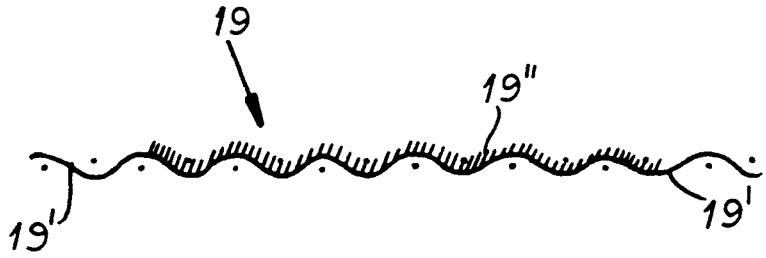
FIG. 6 is a section taken along line VI—VI of FIG. 5.

As seen in FIGS. 1 and 2 a textile-treatment machine has a cylindrical deflecting roll 3 that is stationary and that has a cylindrical outer surface 3' centered on a horizontal axis A. A textile web 19 having a pile-free edge region or strip 19' and a central pile region 19'' passes over this roll 3, deflected by it through about 90°. As seen in FIGS. 5 and 6 the pile-free regions 19' are along both longitudinal edges of the goods 19, and there are periodic pile-free crosswise strips 19''' also, so that the goods 19 can be cut into towels with neat selvedged edges.

The apparatus of the invention has a frame 1 supported by three pairs of rollers 2 on the surface 3' of the roll 3 and carrying a rigid planar plate 9 on which are mounted a pair of axially spaced light sources 7 and 8 and three axially spaced light sensors or detectors 4, 5, and 6. A bracket 21 is secured via bolts 11 to the frame 1 and via bolts 13 to the plate 9. These bolts 11 and 13 pass through respective slots 10 and 12 in the bracket 21 to allow the position of the plate 9 to be adjusted on the frame 1 both radially of the axis A as indicated by arrow 14 and parallel to the axis A.

The source 7 generates a beam $B_7$ that extends tangentially of the surface of the roll 3 and the source 8 generates a fan-shaped beam $B_8$ lying in a plane also tangential of the roll surface. Thus the beam $B_7$ can be picked up by the sensor 4 when not interrupted by the goods 19 and the beam $B_8$ will be picked up by one or both of the sensors 5 and 6 depending on the position of the edge delimiting the pile-free zone 19' and the piled zone 19''.

As seen in FIG. 5 the detectors 4, 5, and 6 are all connected to a controller 22 that operates an actuator shown schematically at 23 that serves to transversely displace the goods 19 and to an air nozzle 24 that pushes back the pile so that the edge between the pile zone 19'' and the pile-free zone 19' is clearly defined. The light sources 7 and 8 and detectors 4, 5, and 6 are diagrammatically illustrated as circles in the positions they occupy when the system is running properly, that is the beam $B_8$ is uninterrupted so it gets to the sensor 6 but not to the sensor 5, and the beam $B_7$ is interrupted by the pile zone 19''. This indicates that the edge of the pile zone 19'' lies between the sensors 5 and 6 where it should be. If the beam $B_8$ to the sensor 6 is blocked the actuator 23 is operated to push the textile 19 to the left as seen in FIG. 5, and if the beam $B_8$ gets through to the sensor 5 the goods 19 are shifted oppositely.

When the beam $B_7$ is no longer interrupted, this indicates that the crosswise pile-free zone 19''' is under the arrangement so that the controller 22 momentarily suspends operation. Otherwise there would be unnecessary attempts on behalf of the apparatus to adjust itself each time a zone 19''' came past the detectors 4 through 6. The above-cited German utility model can be referred to for more details of this style of operation.

The rollers 2 ar arranged in two pairs extending at an angle of 45° to the plane of the plate 9 and engaging the roll surface 3' at 90° offset locations and a third pair equispaced between them and engaging in the direction 14. These rolls 2 are rotatable about axes tangential to an imaginary cylinder centered on the axis A but could be replaced by balls riding in semi-spherical sockets on the frame 1.

Figure 3:
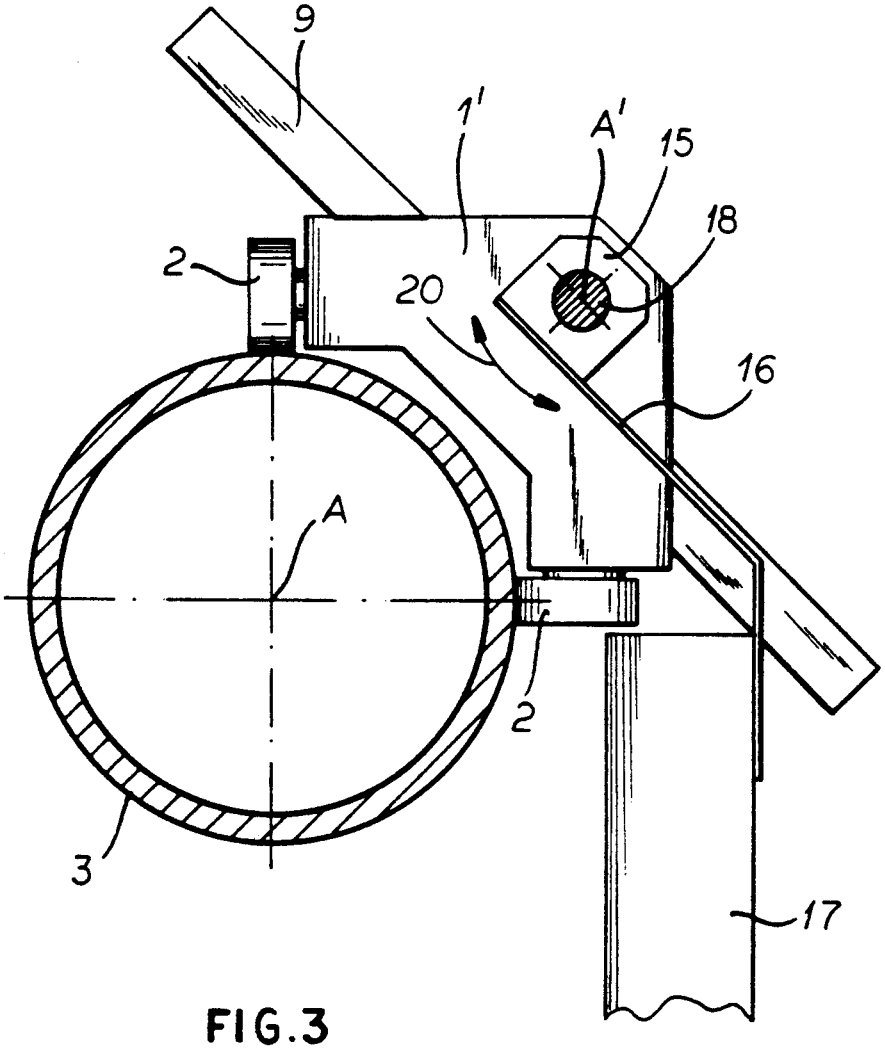
FIGS. 3 and 4 are views like FIGS. 1 and 2, respectively, of another arrangement according to this invention.
Figure 4:
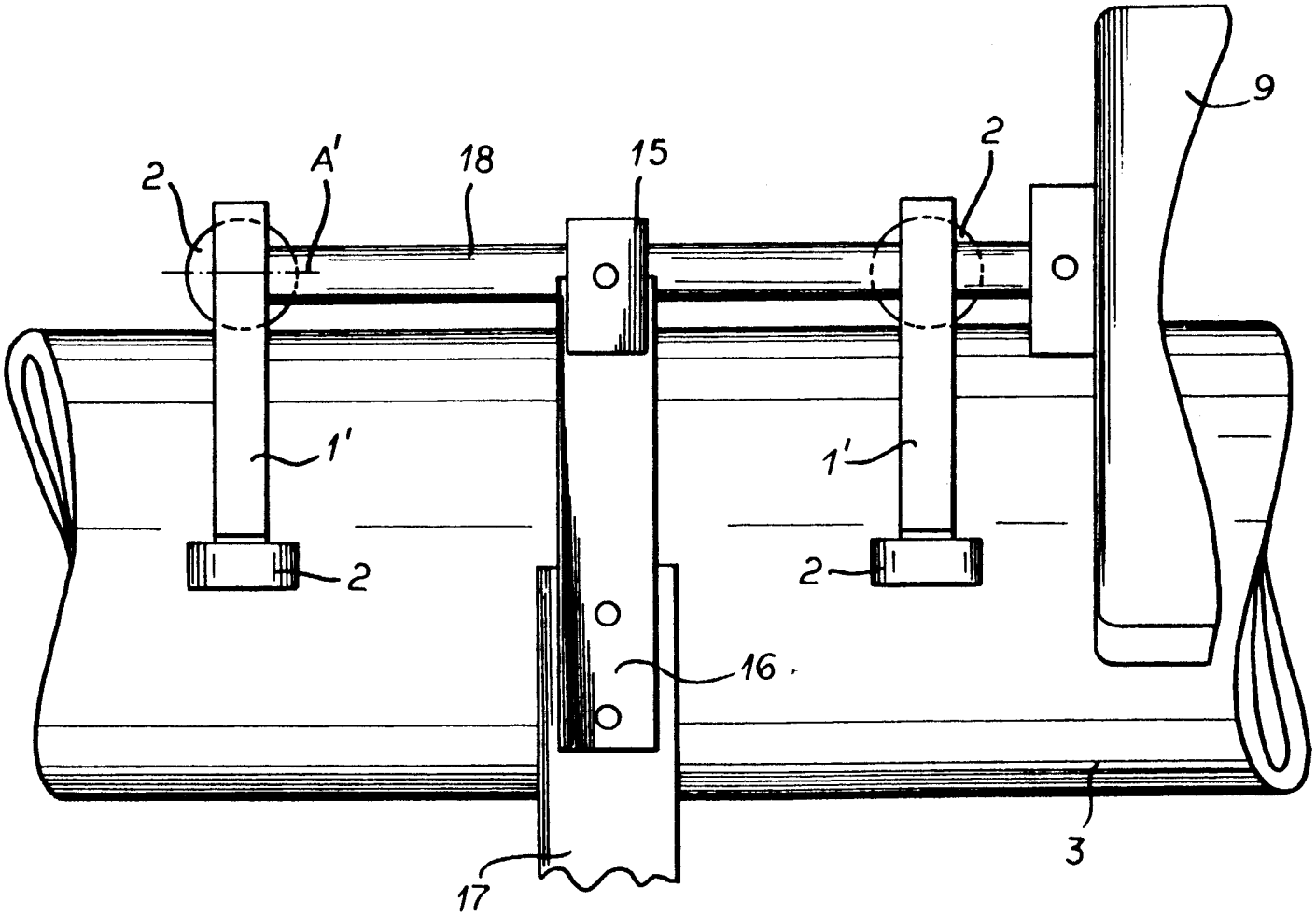

The arrangement of FIGS. 3 and 4 is similar to that of FIGS. 1 and 2, with identical references used for identical structure, except that here the frame 1' has a pair of parts interconnected by a rod 18 pivoted about an axis A' parallel to the axis A on an outer end of a leaf spring 16 whose other end is fixed to a base 17 of the machine having the roll 3. Thus the housing 1' can pivot as indicated by arrow 20 on the rod 18, with most of its weight carried by the support strut 16 but enough of it still bearing by the rollers 2 on the roll 3 to keep it in position thereon. The third set of rollers opposite the plate 9 is not necessary on this embodiment.

I claim:

1. In combination with a machine wherein a pile fabric is deflected over a region of a smooth surface of a deflecting roll centered on an axis, the fabric having a pile-free portion, a pile-detecting apparatus comprising:

a support plate;

a frame carrying the plate;

a plurality of rollers mounted on the frame, riding directly on the surface of the deflecting roll offset from the region of the surface engaged by the fabric, and supporting the plate and frame directly on the surface of the roll;

means on the plate for generating light beams and directing the light beams tangentially of the surface; and means including respective detectors on the plate for receiving the respective light beams.

2. The pile-detecting apparatus define in claim 1 wherein the roll surface is cylindrical and centered on an axis.

3. The pile-detecting apparatus defined in claim 2, further comprising mounting means between the plate and the frame for movement of the plate on the frame radially of the axis and for securing the plate in any of a plurality of radially offset positions thereon.

4. The pile-detecting apparatus defined in claim 3 wherein the mounting means includes a bolt engaged with the frame through a slot in the plate.

5. The pile-detecting apparatus defined in claim 2, further comprising:

mounting means between the plate and the frame for movement of the plate on the frame tangentially of the surface and for securing the plate in any of a plurality of tangentially offset positions thereon.

6. The pile-detecting apparatus defined in claim 5 wherein the mounting means includes a bolt engaged with the frame through a slot in the plate.

7. The pile-detecting apparatus defined in claim 1, further comprising:

means including nozzles on the apparatus for blowing the pile of the fabric parallel to the surface.

8. The pile-detecting apparatus defined in claim 1, wherein there are three such detectors and the generating means emits light beams from two offset locations at the detectors.

9. The pile-detecting apparatus defined in claim 8 wherein one of the light beams is fan-shaped and impinges two of the detectors.

10. The pile-detecting apparatus defined in claim 8, further comprising control means connected to the machine and receiving outputs from the detectors for controlling the machine in accordance with the outputs.

11. The pile-detecting apparatus defined in claim 10 wherein the fabric has crosswise pile-free strips, the apparatus further comprising second generator means on the plate for generating a second light beam inboard of the first-mentioned light beams and directing the second generator means tangentially of the surface such that the second light beam is interrupted except when one of the crosswise pile-free strips pass; and means including a respective detector on the plate for receiving the light beam of the second generating means, the controller temporarily suspending operation on reception of the light beam from the second generating means.

12. The pile-detecting apparatus defined in claim 10, further comprising means connected to the control means and including an actuator for transversely displacing the fabric in accordance with the outputs fed to the control means.

13. In combination with a machine having a stationary base and wherein a pile fabric is deflected over a smooth surface of a deflecting roll, the fabric having a pile-free portion, a pile-detecting apparatus comprising:

a support plate;

a frame carrying the plate;

a plurality of rollers mounted on the frame and riding on the surface of the deflecting roll;

means on the plate for generating light beams and directing the light beams tangentially of the surface;

means including respective detectors on the plate for receiving the respective light beams; and an elastically deformable support strut extending between the base and the frame and partially supporting the apparatus on the base.

14. The pile-detecting apparatus defined in claim 13 wherein the strut is a leaf spring.

15. The pile-detecting apparatus defined in claim 13, further comprising a pivot between the support and the frame.

16. In combination with a machine wherein a pile fabric is deflected over a region of a smooth surface of a deflecting roll centered on an axis, the fabric having a pile-free portion, a pile-detecting apparatus comprising:

a support plate;

a frame carrying the plate;

a plurality of rollers mounted on the frame, riding directly on the surface of the deflecting roll offset from the region of the surface engaged by the fabric, and supporting the plate and frame directly on the surface of the roll, at least two of the rollers being angularly offset from each other;

means on the plate for generating light beams and directing the light beams tangentially of the surface; and means including respective detectors on the plate for receiving the respective light beams.

* * * * *